US009078057B2

(12) United States Patent
Yu et al.

(10) Patent No.: US 9,078,057 B2
(45) Date of Patent: Jul. 7, 2015

(54) ADAPTIVE MICROPHONE BEAMFORMING

(71) Applicant: CSR Technology Inc., Sunnyvale, CA (US)

(72) Inventors: Tao Yu, Rochester Hills, MI (US); Rogerio G. Alves, Macomb Township, MI (US)

(73) Assignee: CSR Technology Inc., Sunnyvale, CA (US)

( * ) Notice: Subject to any disclaimer, the term of this patent is extended or adjusted under 35 U.S.C. 154(b) by 392 days.

(21) Appl. No.: 13/666,101

(22) Filed: Nov. 1, 2012

(65) Prior Publication Data

US 2014/0119568 A1 May 1, 2014

(51) Int. Cl.
*H04R 3/00* (2006.01)

(52) U.S. Cl.
CPC ..... *H04R 3/005* (2013.01)

(58) Field of Classification Search
CPC ..... H04R 3/005
USPC ..... 348/240.1; 381/66, 71.1, 92, 94.2, 119, 381/300, 317, 86; 455/570; 704/226, 228, 704/233; 375/232
See application file for complete search history.

(56) References Cited

U.S. PATENT DOCUMENTS

| | | | | |
|---|---|---|---|---|
| 4,956,867 | A * | 9/1990 | Zurek et al. | 381/94.7 |
| 6,339,758 | B1 * | 1/2002 | Kanazawa et al. | 704/226 |
| 7,031,478 | B2 * | 4/2006 | Belt et al. | 381/92 |
| 7,123,727 | B2 | 10/2006 | Elko et al. | |
| 7,415,117 | B2 * | 8/2008 | Tashev et al. | 381/92 |
| 7,471,799 | B2 * | 12/2008 | Neumann et al. | 381/317 |
| 7,657,038 | B2 | 2/2010 | Doclo et al. | |
| 8,009,841 | B2 | 8/2011 | Christoph | |
| 8,112,272 | B2 * | 2/2012 | Nagahama et al. | 704/226 |
| 8,135,058 | B2 * | 3/2012 | Cookman et al. | 375/232 |
| 8,184,180 | B2 * | 5/2012 | Beaucoup | 348/240.1 |
| 8,428,661 | B2 * | 4/2013 | Chen | 455/570 |
| 8,577,677 | B2 * | 11/2013 | Kim et al. | 704/228 |
| 8,731,212 | B2 * | 5/2014 | Takahashi et al. | 381/92 |
| 8,818,002 | B2 * | 8/2014 | Tashev et al. | 381/94.2 |
| 8,861,756 | B2 * | 10/2014 | Zhu et al. | 381/300 |
| 8,923,529 | B2 * | 12/2014 | McCowan | 381/92 |
| 2003/0138116 | A1 | 7/2003 | Jones et al. | |
| 2004/0252845 | A1 | 12/2004 | Tashev | |
| 2005/0195988 | A1 | 9/2005 | Tashev et al. | |
| 2006/0147063 | A1 * | 7/2006 | Chen | 381/119 |
| 2008/0232607 | A1 | 9/2008 | Tashev et al. | |
| 2009/0271187 | A1 | 10/2009 | Yen et al. | |
| 2010/0241428 | A1 * | 9/2010 | Yiu | 704/233 |
| 2012/0063610 | A1 * | 3/2012 | Kaulberg et al. | 381/71.1 |
| 2012/0076316 | A1 | 3/2012 | Zhu et al. | |

(Continued)

OTHER PUBLICATIONS

Brandstein, M. et al., "Microphone Arrays," New York: Springer, Jun. 15, 2001, pp. 22-26.

(Continued)

*Primary Examiner* — Gerald Gauthier
(74) *Attorney, Agent, or Firm* — John W. Branch; Lowe Graham Jones PLLC

(57) ABSTRACT

The present invention relates to adaptive beamforming in audio systems. More specifically, aspects of the invention relate to a method for adaptively estimating a target sound signal by establishing a simulation model simulating an audio environment comprising: a plurality of spatially separated microphones, a target sound source, and a number of audio noise sources.

20 Claims, 4 Drawing Sheets

(56) References Cited

U.S. PATENT DOCUMENTS

| | | | | |
|---|---|---|---|---|
| 2012/0093344 | A1 | 4/2012 | Sun et al. | |
| 2012/0114138 | A1* | 5/2012 | Hyun | 381/92 |
| 2012/0243698 | A1* | 9/2012 | Elko et al. | 381/66 |
| 2013/0136274 | A1* | 5/2013 | Ahgren | 381/92 |
| 2014/0119568 | A1* | 5/2014 | Yu et al. | 381/92 |
| 2014/0153740 | A1* | 6/2014 | Wolff et al. | 381/92 |
| 2014/0270219 | A1* | 9/2014 | Yu et al. | 381/71.1 |
| 2014/0270241 | A1* | 9/2014 | Yu et al. | 381/86 |
| 2015/0063589 | A1* | 3/2015 | Yu et al. | 381/92 |

OTHER PUBLICATIONS

Buckley, K. M. et al., "An Adaptive Generalized Sidelobe Canceller with Derivative Constraints," IEEE Transactions on Antennas and Propagtation, vol. AP-34, No. 3, Mar. 1986, pp. 311-319.

Elko, G. W. et al., "A Simple Adaptive First-Order Differential Microphone," IEEE Workshop on Applications of Signal Processing to Audio and Acoustics, New Platz, NY, Oct. 15-18, 1995, pp. 169-172.

Elko, G. W. et al., "Second-Order Differential Adaptive Microphone Array," IEEE International Conference on Acoustics Speech and Signal Processing, Taipei, Taiwan, Apr. 19-24, 2009, pp. 73-76.

Griffiths, L. J. et al., "An Alternative Approach to Linearly Constrained Adaptive Beamforming," IEEE Transactions on Antennas and Propagation, vol. AP-30m No. 1, Jan. 1982, pp. 27-34.

Haykin, S., "Adaptive Filter Theory," 3rd Edition, Englewood Cliffs: Prentice Hall, Dec. 27, 1995, pp. 341-343.

Hoshuyama, O. et al., "A Robust Adaptive Beamformer for Microphone Arrays with a Blocking Matrix Using Constrained Adaptive Fiiters," IEEE Transactions on Signal Processing, Vol, 47, No. 10, Oct. 1999, pp. 2677-2684.

Hyvärinen, A. et al., "Independent Component Analysis," John Wiley & Sons, May 18, 2001, pp. 1-491.

Li, H. et al., "A Class of Complex ICA Algorithms Based on the Kurtosis Cost Function," IEEE Transactions on Neural Networks, vol. 19, No. 3, Mar. 2008, pp. 408-420.

Van Trees, H. L., "Optimum Array Processing, 6.2 Optimum Beamformers," New York: Wiley, Apr. 4, 2002, pp. 439-452.

Van Trees, H. L., "Optimum Array Processing, 7.3 Sample Matrix Inversion (SMI)," New York: Wiley, Apr. 4, 2002, pp. 728-731.

Yu, T. et al., "Automatic Beamforming for Blind Extraction of Speech from Music Environment Using Variance of Spectral Flux Inspired Criterion," IEEE Journal of Selected Topics in Signal Processing, vol. 4, No. 5, Oct. 2010, pp. 785-797.

U.S. Appl. No, 13/842,911, filed Mar. 15, 2013.

Office Communication for U.S. Appl. No. 13/842,911 mailed on Apr. 2, 2015 (15 pages).

* cited by examiner

ADAPTIVE MICROPHONE BEAMFORMING

The present invention relates to adaptive beamforming in audio systems. More specifically, aspects of the invention relate to a method of dynamically updating beamforming weights for a multi-microphone audio receiver system, and apparatus for carrying out said method.

Audio receivers are often used in environments in which the target sound source is not the only sound source; undesirable background noise and/or interference may also be present. For example a hands free kit for use of a mobile telephone whilst driving may comprise a microphone mounted on a vehicle dashboard or on a headset worn by the user. In addition to the user's direct speech signal, such microphones may pick up noise caused by nearby traffic or the vehicle's own engine, vibrations caused by the vehicle's progress over a road surface, music played out through in-vehicle speakers, passenger speech and echoes of any of these generated by reflections around the vehicle interior. Similarly, during a teleconference it is desired that only the direct speech signal of the person presently talking is picked up by the telephone's microphone, not echoes off office walls, or the sounds of typing, conversation or telephones ringing in adjacent rooms.

One method of addressing this problem is to use a microphone array (in place of a single microphone) and beamforming techniques. To illustrate such techniques FIG. 1 depicts an audio environment 101 comprising an M-element linear microphone array 102, target sound (s) source 103 at an angle $\theta_s$ to the line of the microphones, and environmental noise and interference (n) sources 104-106.

The target or desired sound will typically be human speech, as in the examples described above. However in some environments a non-speech signal may be the target. Methods and apparatus described in the following with reference to target or desired speech or similar are also to be understood to apply to non-speech target signals.

The signal model in each time-frame and frequency-bin (or sub-band) can be written as $$x(t,k)=a(t,k,\theta_s)s(t,k)+n(t,k) \tag{1}$$

where $x \in C^{M\times 1}$ is the array observation signal vector (e.g., noisy speech) received by the array, $s \in C$ is the desired speech, $n \in C^{M\times 1}$ represents the background noise plus interference, and t and k are the time-frame index and frequency bin (sub-band) index, respectively. The array steering vector $a \in C^{M\times 1}$ is a function of the direction-of-arrival (DOA) $\theta_s$ of the desired speech.

Making the assumption that the received signal components in the model of equation (1) are mutually uncorrelated, the correlation matrix of the received signal vector can be expressed as $$R_{xx}(k)=E\{x(t,k)x^H(t,k)\}=R_{ss}(k)+R_{nn}(k) \tag{2}$$

where $R_{ss} \in C^{M\times M}$ and $R_{nn} \in C^{M\times M}$ are respectively the correlation matrices for the desired speech and noise.

In order to recover an estimate y(t,k) of the desired speech the received signal can be acted on by a linear processor consisting of a set of complex beamforming weights. That is:

$$y(t,k)=\hat{s}(t,k)=w^H(t,k)x(t,k) \tag{3}$$

The beamformer weights can be computed using optimization criteria, such as minimum mean square error (MMSE), minimum variance distortionless response (MVDR) or maximum signal-to-noise ratio (Max-SNR). Generally, the optimal weights may be presented in the form:

$$w(t,k)=\xi(k)R_{nn}^{-1}(k)a(t,k,\theta_s) \tag{4}$$

where $\xi$ is a scale factor dependent on the optimization criterion in each frequency bin.

Substituting equation (1) into equation (3) gives:

$$y(t,k)=\hat{s}(t,k)=w^H(t,k)a(t,k,\theta_s)s(t,k)+w^H(t,k)n(t,k) \tag{5}$$

Equation (5) shows that in order to prevent any artifacts being introduced into the target speech, the beamformer weights must satisfy the constraint $$w^H(t,k)a(t,k,\theta_s)=1 \tag{6}$$

In addition, the beamformer weights should be chosen so as to make the noise term in equation (5) as small as possible.

The classical distortionless beamformer is the delay-and-sum beamformer (DSB) with solution:

$$w_{DSB}(t,k)=\frac{1}{M}a(t,k,\theta_s) \tag{7}$$

An alternative beamformer is the MVDR which is derived from the minimisation of the output noise power with solution:

$$w_{MVDR}(t,k)=\frac{1}{a^H(t,k,\theta_S)R_{nn}^{-1}(k)a(t,k,\theta_s)}R_{nn}^{-1}(k)a(t,k,\theta_s) \tag{8}$$

Current beamforming systems have several problems. Some make the far-field approximation; that the distance between the target sound source and the microphone array is much greater than any dimension of the array, and thus the target signal arrives at all microphones with equal amplitude. However this is not always the case, for example a hands-free headset microphone may be very close to the user's mouth. Amplitude is not only affected by distance travelled; air fluctuations, quantisation effects and microphone vibrations may also cause amplitude differences between microphones in a single array, together with variation in inherent microphone gain. Many techniques require estimation of the noise correlation matrix using a voice activity detector (VAD). However VADs do not perform well in non-stationary noise conditions and cannot separate target speech from speech interferences. Some methods also have inherent target signal cancellation problems.

What is needed is an adaptive beamforming method and system which does not rely on an unjustified far-field approximation or a VAD.

According to a first aspect of the invention, there is provided a method for adaptively estimating a target sound signal, the method comprising: establishing a simulation model simulating an audio environment comprising: a plurality of spatially separated microphones, a target sound source, and a number of audio noise sources; setting an initial value for each of one or more variables, each variable parameterising a comparison of audio signals received at a respective first one of the plurality of microphones with audio signals received at a respective second one of the plurality of microphones; in dependence on audio signals received by the plurality of microphones, updating the value of said one or more variables; using the updated value of said one or more variables to determine a respective adaptive beamforming weight for each of the plurality of microphones; and summing the audio signals received by each of the plurality of microphones according to their respective beamformer weights to produce an estimate of the target sound signal.

According to a second aspect of the invention there is provided an adaptive beamforming system for estimating a target sound signal in an audio environment comprising a target sound source and a number of audio noise sources, the system comprising: a plurality of spatially separated microphones; a beamformer unit to which signals received by the plurality of microphones are input, and which is configured to estimate the target sound signal by summing the signals from the plurality of microphones according to beamformer weights; and an optimization unit to which the output of the beamformer unit is input, and which is configured to output a control signal to the beamformer unit which adaptively adjusts the beamformer weights; wherein the optimization unit is configured to: set an initial value for each of one or more variables, each variable parameterising a comparison of audio signals received at a respective first one of the plurality of microphones with audio signals received at a respective second one of the plurality of microphones; in dependence on audio signals received by the plurality of microphones, update the value of said one or more variables; and use the updated value of said one or more variables to construct the control signal.

The plurality of microphones may be arranged in a linear array.

The system may comprise two spatially separated microphones only.

The system may be configured for use in a hands-free headset.

The system may be configured for use in a dashboard-mounted hands-free kit.

The system may be configured for use in a conference call unit.

The system may further comprise a single channel post-filter configured to produce an estimate of the target sound source power from the beamformer unit output.

One of the one or more variables may parameterise the difference in the amplitude of the target sound signal received by each of the plurality of microphones compared to one of the plurality of microphones designated as a reference microphone.

The initial value of at least one of said one or more variables may be set according to a far-field approximation.

If one of the one or more variables parameterises the difference in the amplitude of the target sound signal received by each of the plurality of microphones compared to one of the plurality of microphones designated as a reference microphone then the variable parameterising the difference in the amplitude of the target sound signal received by each of the plurality of microphones compared to one of the plurality of microphones designated as a reference microphone may be limited to plus or minus less than a tenth of its initial value.

For one or more of the one or more variables the comparison may be with respect to the quality of the audio signals received at the respective first and second ones of the plurality of microphones. If so, then for one or more of the one or more variables the comparison may be with respect to an estimation of the net signal received at each of the respective first and second ones of the plurality of microphones from the number of audio noise sources. If so, then for one or more of the one or more variables the first one of the plurality of microphones may be the same as the second one of the plurality of microphones. If so, then one or more of the one or more variables may parameterise an average degree of self-correlation of the net signal received by one of the plurality of microphones from the number of audio noise sources.

If for one or more of the one or more variables the comparison is with respect to an estimation of the net signal received at each of the respective first and second ones of the plurality of microphones from the number of audio noise sources, then for one or more of the one or more variables the first one of the plurality of microphones may be different to the second one of the plurality of microphones. If so, then one or more of the one or more variables may parameterise a degree of cross correlation of the net signal received by each respective first one of the plurality of microphones from the number of audio noise sources with the net signal received by each respective second one of the plurality of microphones from the number of audio noise sources.

If for one or more of the one or more variables the comparison is with respect to the quality of the audio signals received at the respective first and second ones of the plurality of microphones, then the initial value of each of the said one or more variables may be set such that an initial estimation of the correlation matrix formed by cross correlating the estimated net signals received by each of the plurality of microphones from the number of audio noise sources with each other is equal to the diffuse noise correlation matrix for said plurality of spatially separated microphones.

If one or more of the one or more variables parameterises an average degree of self-correlation of the net signal received by one of the plurality of microphones from the number of audio noise sources then the variable parameterising the average degree of self-correlation of the net signal received by one of the plurality of microphones from the number of audio noise sources may be limited to be greater than or equal to unity and less than or equal to approximately 100.

If one or more of the one or more variables parameterises a degree of cross correlation of the net signal received by each respective first one of the plurality of microphones from the number of audio noise sources with the net signal received by each respective second one of the plurality of microphones from the number of audio noise sources, then the one or more variables parameterising the degree of cross correlation of the net signal received by each respective first one of the plurality of microphones from the number of audio noise sources with the net signal received by each respective second one of the plurality of microphones from the number of audio noise sources may be limited to having real components greater than or equal to zero and less than approximately unity, and imaginary parts between approximately plus and minus 0.1.

Beamformer weights may be determined so as to minimise the power of the estimated target sound signal.

The one or more variables may be updated according to a steepest descent method. If so, then a normalised least mean square (NLMS) algorithm may be used to limit a step size used in the steepest descent method. If so, then the NLMS algorithm may comprise a step of estimating the power of the signals received by each of the plurality of microphones, wherein that step is performed by a 1-tap recursive filter with adjustable time coefficient or weighted windows with adjustable time span which averages the power in each frequency bin.

If the one or more variables are updated according to a steepest descent method, then the step size used in the steepest descent method may be reduced to a greater extent the greater the ratio of estimated target signal power to the signal power received by one of the plurality of microphones designated as a reference microphone.

The phase of the estimated target signal may be the phase of one of the plurality of microphones designated as a reference microphone.

Aspects of the present invention will now be described by way of example with reference to the accompanying figures. In the figures.

The following description is presented to enable any person skilled in the art to make and use the system, and is provided in the context of a particular application. Various modifications to the disclosed embodiments will be readily apparent to those skilled in the art.

The general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

A multi-microphone audio receiver system will now be described which implements adaptive beamforming in which dynamic changes in a comparison of audio signals received by individual microphones in the beamforming array are taken into account. This is achieved by determining beamforming weights in dependence on one or more variables parameterising such a comparison. The variable(s) may be assigned initial values according to a model of the initial audio environment and updated iteratively using the received signals.

In the following, the time frame and frequency bin indexes t and k are omitted for the sake of clarity. The explanation is given for an exemplary two-microphone array, however more than two microphones could be used.

Figure 1:
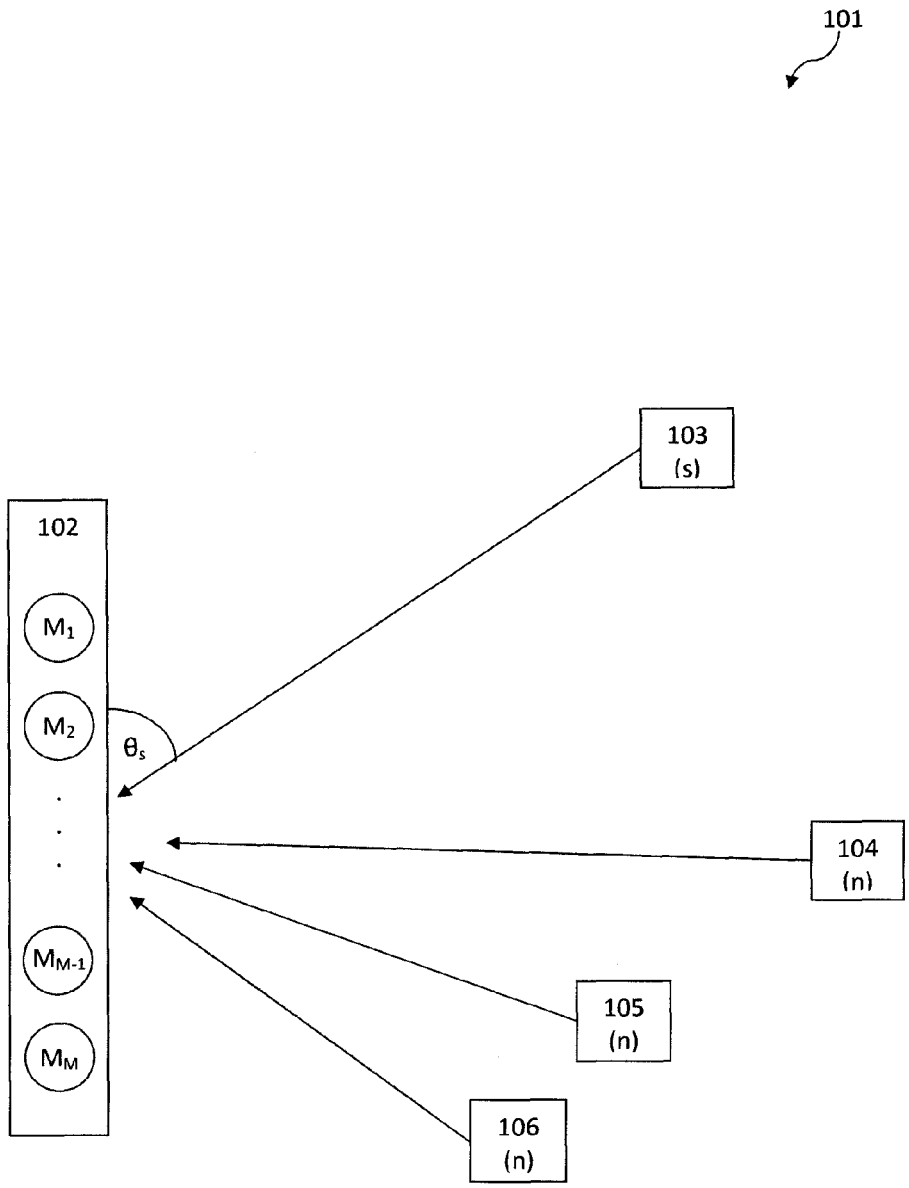
FIG. 1 depicts an example audio environment.

Beamforming weights may be calculated for a system such as that shown in FIG. 1 using variables with values initially set in such a way as to take into account the spatial separation of the two microphones and then iterated to update the beamforming weights adaptively.

One such variable which may be introduced is a transportation degradation factor β, incorporated into the array steering vector to take into account the difference in amplitude of the target speech at each of the microphones. For example, the additional degradation in amplitude of the signal from the target source when received by the microphone furthest from the target source (the second microphone) as compared to the microphone closest to the target source (the reference microphone). The array steering vector may then be expressed as $$a(\theta_s,\beta)=[1,\beta e^{-j\phi(\theta_s)}] \tag{9}$$

where $\phi(\theta_s)$ is the phase difference of the target speech in the second microphone compared to the reference microphone. (Note that in this model the DOA of the target speech is assumed to be fixed so the phase difference $\phi(\theta_s)$ is a constant.) The reference microphone need not be the microphone closest to the target source, but this is generally the most convenient choice.

Other variables which may be introduced could parameterise a comparison of the quality of signals received by the microphones. For example the size or relative size of an estimation of the received noise component. Such variables could be a diagonal loading factor σ and a cross correlation factor ρ. These may be used to define the noise correlation matrix as:

$$R_{nn}=\begin{bmatrix}\sigma & \rho\\ \rho^* & \sigma\end{bmatrix} \tag{10}$$

where σ has values in [1, +∞], and ρ is a complex value. The inverse of the noise correlation matrix is then $$R_{nn}^{-1}=\frac{1}{\sigma^2-\rho\rho^*}\begin{bmatrix}\sigma & -\rho\\ -\rho^* & \sigma\end{bmatrix} \tag{11}$$

Equations (9) and (11) may be substituted into equation (8) to obtain the MVDR beamformer weights as:

$$w=\frac{1}{\sigma(\beta^2+1)-\beta(\rho e^{j\phi(\theta_s)}+\rho^* e^{-j\phi(\theta_s)})}\begin{bmatrix}\sigma-\rho\beta e^{j\phi(\theta_s)}\\ -\rho^*+\sigma\beta e^{j\phi(\theta_s)}\end{bmatrix} \tag{12}$$

Suitable initialisation parameters may depend on the structure of the microphone array and the target speech DOA. In an example where the DOA is 30 degrees and the microphone separation is 4.8 cm they could be, for example, as follows. β could be approximately 0.7 in the case of a hands-free headset array, with larger values of β (approaching a maximum of 1) used in situations more closely resembling the far-field approximation such as a dashboard-mounted hands-free kit or conference call unit. The initial noise correlation matrix could be the diffuse noise correlation matrix wherein σ=1 and ρ=sinc(fd/c) where f is frequency, d is the separation of the two microphones and c is the speed of sound.

A minimal output power criterion may then be used in an iteration process that solves for the uncertainty variables (in this example β, σ and ρ). To do this, a cost function to be minimised can be defined as:

$$J(\beta,\sigma,\rho)=E\{|w^H x|^2\} \tag{13}$$

with J being defined as:

$$J=J_1 * J_2 \tag{14}$$

where $$J_1=\left(\frac{1}{\sigma(\beta^2+1)-\beta(\rho e^{j\phi(\theta_s)})+\rho^* e^{-j\phi(\theta_s)}}\right)^2 \tag{15}$$

and $$\begin{aligned}J_2=&|x_1|^2\{\sigma^2-\sigma\beta(\rho e^{j\phi(\theta_s)}+\rho^* e^{-j\phi(\theta_s)})+\beta^2\rho\rho^*\}+\\ &x_1x_2^*\{-\sigma\rho^*+\sigma^2\beta e^{j\phi(\theta_s)}+\beta(\rho^*)^2 e^{-j\phi(\theta_s)}-\sigma\beta^2\rho^*\}+\\ &x_1^*x_2\{-\sigma\rho+\sigma^2\beta e^{-j\phi(\theta_s)}+\beta\rho^2 e^{j\phi(\theta_s)}-\sigma\beta^2\rho\}+\\ &|x_2|^2\{\rho\rho^*-\sigma\beta(\rho e^{j\phi(\theta_s)}+\rho^* e^{-j\phi(\theta_s)})+\sigma^2\beta^2\},\end{aligned} \tag{16}$$

where $[x_1; x_2]=x$ are the elements of the observation vector (total received signal). Thus the cost function has been defined in terms of a data-independent power-normalisation factor $J_1$ and a data-driven noise reduction capability factor $J_2$.

A steepest descent method may then be used as a real-time iterative optimization algorithm as follows.

$$\begin{aligned}\sigma^{t+1}&=\sigma^t-\mu_\sigma\frac{\partial J}{\partial\sigma}\\ &=\sigma^t-\mu_\sigma\left(\frac{\partial J_1}{\partial\sigma}J_2+\frac{\partial J_2}{\partial\sigma}J_1\right)\end{aligned} \tag{17}$$

$$\begin{aligned}\beta^{t+1}&=\beta^t-\mu_\beta\frac{\partial J}{\partial\beta}\\ &=\beta^t-\mu_\beta\left(\frac{\partial J_1}{\partial\beta}J_2+\frac{\partial J_2}{\partial\beta}J_1\right)\end{aligned} \tag{18}$$

-continued $$\rho^{t+1} = \rho^t - \mu_\rho \frac{\partial J}{\partial \rho^*} = \rho^t - \mu_\rho \left( \frac{\partial J_1}{\partial \rho^*} J_2 + \frac{\partial J_2}{\partial \rho^*} J_1 \right) \tag{19}$$

where $\mu_\sigma$, $\mu_\beta$ and $\mu_\rho$ are step size control parameters for updating σ, β and ρ respectively.

These updating rules are similar to the least mean square (LMS) algorithm. In order to avoid the updating mechanism being too dependent on input signal power as in LMS, and to increase the convergence rate of the algorithm, a normalised LMS (NLMS) algorithm may be used. That is, the step size control parameters may be adjusted according to the input power level as $$\mu(t) = \mu(0) \frac{1}{|x_1|^2 + |x_2|^2} \tag{20}$$

where $|x_1|^2$ and $|x_2|^2$ are the estimated power of the signals received at the first and second microphones respectively, μ(0) is the initial value of the relevant step size control parameter and μ(t) is its updated value in time frame t. The power levels of the input signals may be estimated by averaging the power in each frequency bin with a 1-tap recursive filter with adjustable time coefficient or weighted windows with adjustable time span. Promptly following increases in input power prevents instability in the iteration process. Promptly following decreases in input power levels avoids unnecessary parameter adaptation, improving the dynamic tracking ability of the system.

Step size control can be further improved by reducing the step size when there is a good target to signal ratio. This means that as an optimal solution is approached the iteration is restricted so that the beamforming is not likely to be altered enough to take it further away from its optimal configuration. Conversely, when the beamforming is producing poor results, the iteration process can be allowed to explore a broader range of possibilities so that it has improved prospects of hitting on a better solution. The target to noise ratio (TR) can be defined as:

$$TR - \frac{|y|^2}{|x_1|^2} \tag{21}$$

where $|y|^2$ is the estimated target signal power and the signal received by microphone 1 is used as the reference. The adaptive step size may be adjusted by a factor of (1-TR) to give a refined version of equation (20) as:

$$\mu(t) - \mu(0) \frac{1}{|x_1|^2 + |x_2|^2} \left( 1 - \frac{|y|^2}{|x_1|^2} \right) \tag{22}$$

Estimation of the target speech power may be performed at the microphone array processing output; this works well when the adaptive filter is working close to optimum or if the output signal to noise ratio is much higher than that in the input. Alternatively, if a single channel post-filter is used after the beamforming system then target speech power may be estimated after the post-filter where stationary noise (i.e. non-time-varying background noise) is greatly reduced.

The gradients for updating each of the uncertainty factors β, σ and ρ are as follows.

$$\frac{\partial J_1}{\partial \beta} = 2\left( \frac{1}{\sigma(\beta^2+1) - \beta(\rho e^{j\phi(\theta_s)} + \rho^* e^{-j\phi(\theta_s)})} \right)^3 (2\beta\sigma - (\rho e^{j\phi(\theta_s)} + \rho^* e^{-j\phi(\theta_s)})) \tag{23}$$

$$\frac{\partial J_1}{\partial \sigma} = -2\left( \frac{1}{\sigma(\beta^2+1) - \beta(\rho e^{j\phi(\theta_s)} + \rho^* e^{-j\phi(\theta_s)})} \right)^3 (\beta^2+1) \tag{24}$$

$$\frac{\partial J_1}{\partial \rho^*} = 2\left( \frac{1}{\sigma(\beta^2+1) - \beta(\rho e^{j\phi(\theta_s)} + \rho^* e^{-j\phi(\theta_s)})} \right)^3 \beta e^{-j\phi(\theta_s)} \tag{25}$$

$$\begin{aligned} \frac{\partial J_2}{\partial \beta} = {} & |x|^2\{\sigma(\rho e^{j\phi(\theta_s)} + \rho^* e^{-j\phi(\theta_s)}) + 2\beta\rho\rho^*\} + \\ & x_1 x_2^*\{\sigma^2 e^{j\phi(\theta_s)} + (\rho^*)^2 e^{-j\phi(\theta_s)} - 2\sigma\beta\rho^*\} + \\ & x_1^* x_2\{\sigma^2 e^{-j\phi(\theta_s)} + \rho^2 e^{j\phi(\theta_s)} - 2\sigma\beta\rho\} + \\ & |x_2|^2\{-\sigma(\rho e^{j\phi(\theta_s)} + \rho^* e^{-j\phi(\theta_s)}) + 2\sigma^2\beta\} \end{aligned} \tag{26}$$

$$\begin{aligned} \frac{\partial J_2}{\partial \sigma} = {} & |x_1|^2\{2\sigma - \beta(\rho e^{j\phi(\theta_s)} + \rho^* e^{-j\phi(\theta_s)})\} + \\ & x_1 x_2^*\{-\rho^* + 2\sigma\beta e^{j\phi(\theta_s)} - \beta^2\rho^*\} + x_1^* x_2\{-\rho + 2\sigma\beta e^{-j\phi(\theta_s)} - \beta^2\rho\} + \\ & |x_2|^2\{-\beta(\rho e^{j\phi(\theta_s)} + \rho^* e^{-j\phi(\theta_s)}) + 2\sigma\beta^2\} \end{aligned} \tag{27}$$

$$\begin{aligned} \frac{\partial J_2}{\partial \rho^*} = {} & |x_1|^2\{-\sigma\beta e^{-j\phi(\theta_s)} + \beta^2\rho\} + \\ & x_1 x_2^*\{-\sigma + 2\beta\rho^* e^{-j\phi(\theta_s)} - \sigma\beta^2\} + |x_2|^2\{\rho - \sigma\beta e^{-j\phi(\theta_s)}\}. \end{aligned} \tag{28}$$

Since $J_1$ is non-linear, multiple locally optimal solutions may be found using update equations (17)-(19). Therefore to obtain a practically optimal solution the initial values of the variables may be carefully set, for example as discussed above, and limitations may be imposed on them. Suitable limits may depend on the structure of the microphone array and the target speech DOA. Again using the example where the DOA is 30 degrees and the microphone separation is 4.8 cm they could be, for example, as follows. β could be limited to its initial value plus or minus a small positive number ϵ ($0 \le \epsilon \ll 1$). ϵ will usually be <0.1. σ may be limited to $1 \le \sigma \le \sigma_{max}$ where $\sigma_{max}$ is a large positive number, for example of the order of 100. The real part of ρ should generally be a small positive number, so could be limited by $0 \le \mathrm{Re}(\rho) \le 0.95$ for example. ρ should generally be real, so the imaginary part may be limited as $-0.1 \le \mathrm{Img}(\rho) \le 0.1$. Provided $|\rho| \ll 1$, the beamformer behaves similarly to the delay-and-sum beamformer and therefore has the ability to reduce incoherent noise (e.g. wind noise, thermal noise etc.) and is robust to array errors such as signal quantisation errors and the near-far effect.

It has been found that even with all the improvements introduced by the techniques described above, residual noise distortion can still introduce unpleasant listening effects. This problem can be severe when the interference noise is speech, especially vowel sounds. Artifacts can be generated at the valley between two nearby harmonics in the residual noise. This problem can be solved by employing the phase from the reference microphone as the phase of the beamformer output. That is:

$$y_{out} = |w^H x| \exp(j \cdot \mathrm{phase}(x_{ref})) \tag{29}$$

where $\mathrm{phase}(x_{ref})$ denotes the phase from the reference microphone (e.g. microphone 1) input.

While using all of the techniques described above in combination may produce accurate results, in some situations it may be preferable to save on processing power (and hence battery power and memory chip size in the case of e.g. small portable devices) by not solving for every uncertainty variable. For example, a simplified approach may be to assume that both β and σ can be taken to be unity so that only ρ (the cross correlation factor) is optimised. This allows the beamformer weights of equation (12) to be simplified to:

$$w = \frac{1}{2-(\rho e^{j\phi(\theta_s)}+\rho^* e^{-j\phi(\theta_s)})}\begin{bmatrix} 1-\rho e^{j\phi(\theta_s)} \\ -\rho^* + e^{j\phi(\theta_s)} \end{bmatrix} \tag{30}$$

The cost function $J_1$ of equation 15 is:

$$J_1 = \left(\frac{1}{2-(\rho e^{j\phi(\theta_s)}+\rho^* e^{-j\phi(\theta_s)})}\right)^2 \tag{31}$$

and $J_2$ of equation (16) is:

$$\begin{aligned} J_2 = (|x_1|^2+|x_2|^2)*\{1-(\rho e^{j\phi(\theta_s)}+\rho^* e^{-j\phi(\theta_s)})+\rho\rho^*\}+ \\ x_1x_2^*\{-2\rho^*+e^{j\phi(\theta_s)}+(\rho^*)^2 e^{-j\phi(\theta_s)}\}+ \\ x_1^*x_2\{-2\rho+e^{-j\phi(\theta_s)}+\rho^2 e^{j\phi(\theta_s)}\}. \end{aligned} \tag{32}$$

The gradients of equations (25) and (28) are then respectively:

$$\frac{\partial J_1}{\partial \rho^*} = 2\left(\frac{1}{2-(\rho e^{j\phi(\theta_s)}+\rho^* e^{-j\phi(\theta_s)})}\right)^3 e^{-j\phi(\theta_s)} \tag{33}$$

and $$\frac{\partial J_2}{\partial \rho^*} = (|x_1|^2+|x_2|^2)*\{-e^{-j\phi(\theta_s)}+\rho\}+x_1x_2^*\{-2+2\rho^* e^{-j\phi(\theta_s)}\}. \tag{34}$$

Substituting equations (33) and (34) into equation (19) then gives a simplified updating rule for ρ. New beamforming weights can then be computed through equation (30) and finally an estimation of the target speech can be obtained using equation (3).

Figure 2:
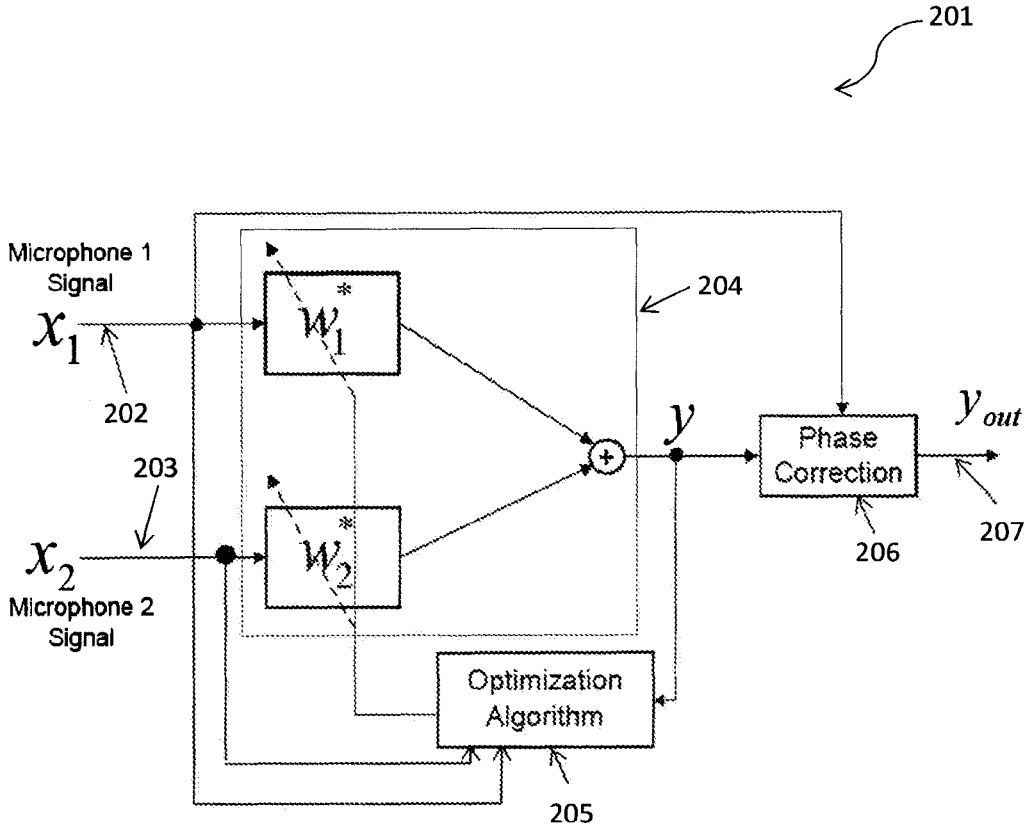
FIG. 2 shows an example adaptive beamforming system.

FIG. 2 is a schematic diagram of how the system described above may be implemented, including the optional phase correction process. FIG. 2 shows an adaptive beamforming apparatus 201 for use in an audio receiver system such as a hands-free kit or conference call telephone. The audio receiver system comprises an array of two microphones whose outputs $x_1$ and $x_2$ are connected to inputs 202 and 203 respectively. These inputs are then weighted and summed by beamformer unit 204 according to equations (3) and (12). The beamforming processing is a spatial filtering formulated as $$y = w^*_1 x_1 + w^*_2 x_2 \tag{35}$$

where y is the output of the beamformer. The beamformer unit output y is then fed into optimization unit 205 which performs the adaptive algorithm described above to produce improved beamformer weights which are fed into beamformer unit 204 for processing of the next input sample. The beamformer unit output signal is also passed to phase correction module 206 which processes the signal according to equation (29) to produce a final output signal $y_{out}$, the estimation of the target sound (typically speech) signal.

Figure 3:
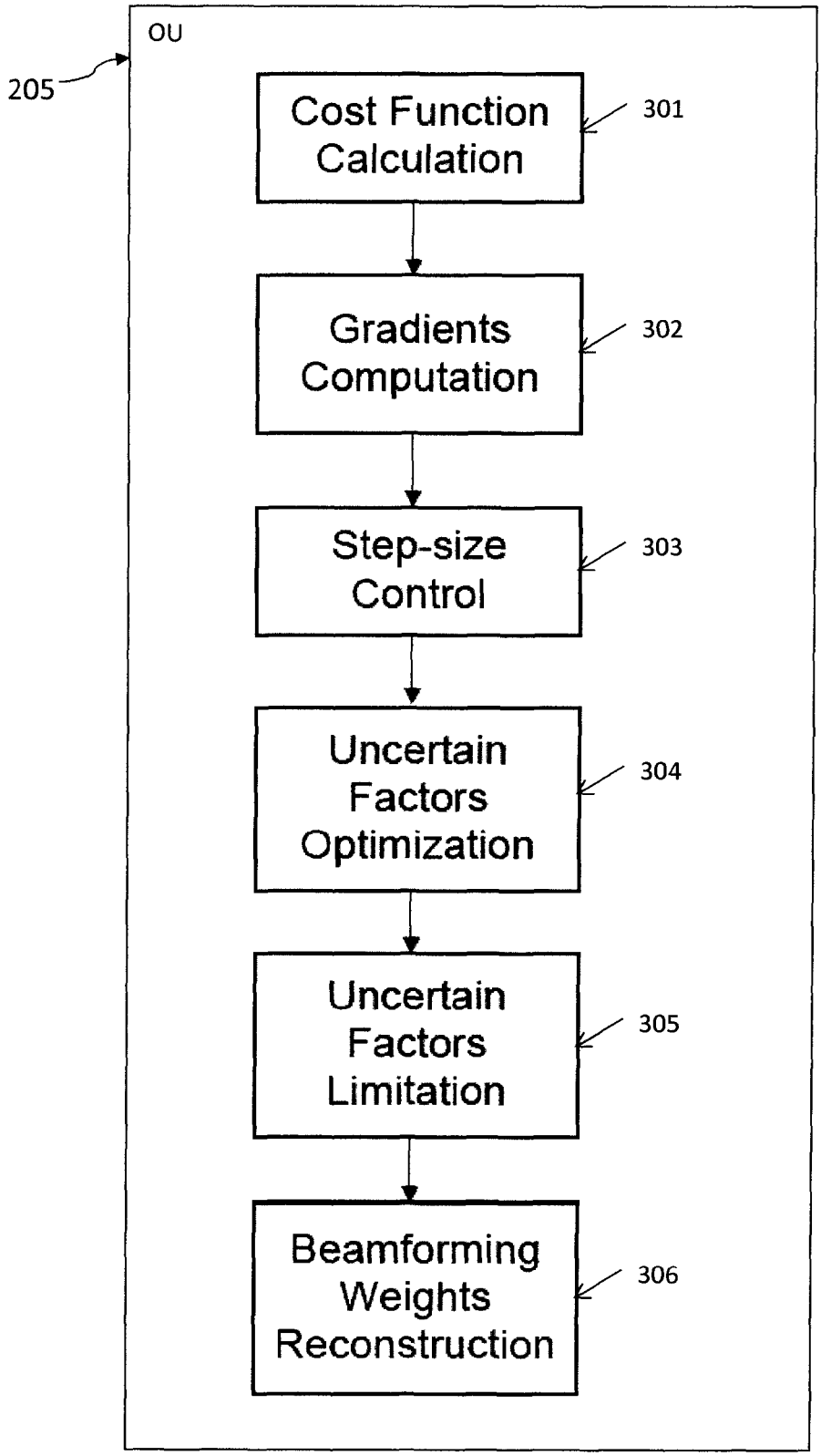
FIG. 3 illustrates example sub-modules of an optimization unit.

FIG. 3 illustrates sub-modules which may be comprised in an exemplary optimization unit 205. Suitably, cost function calculation unit 301 implements equations (14)-(16). Suitably, gradients computation unit 302 implements equations (23)-(28). Optionally, step-size control unit 303 implements equation (20) or equation (22). Suitably, uncertain factors optimization unit 304 implements equations (17)-(19). Optionally, uncertain factors limitation unit 305 applies limits to the uncertain factors, for example as discussed above. Finally, beamformer weights reconstruction unit 306 suitably updates the beamformer weights according to equation (12).

Figure 4:
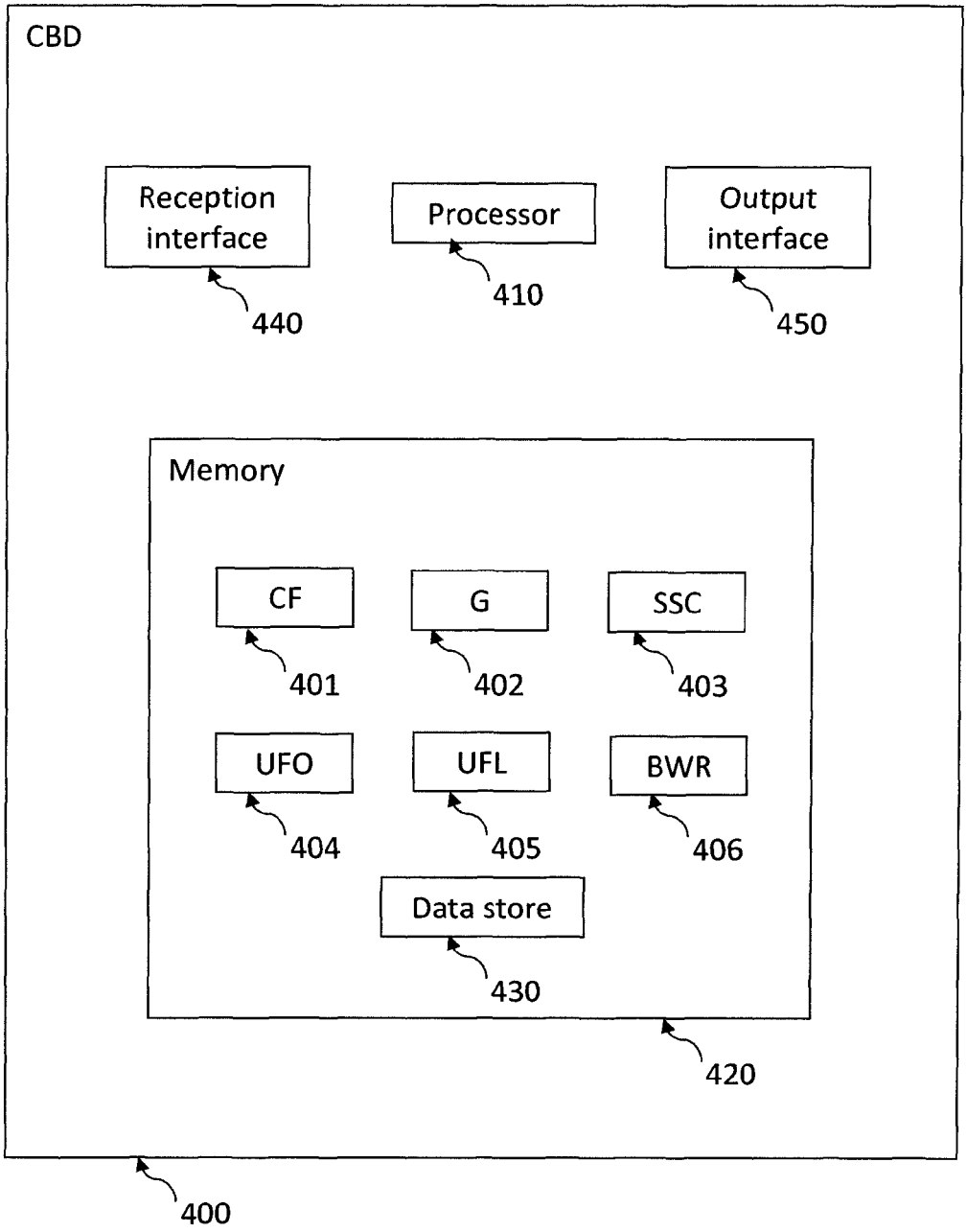
FIG. 4 illustrates an example computing-based device in which the method described herein may be implemented.

Reference is now made to FIG. 4. FIG. 4 illustrates a computing-based device 400 in which the estimation described herein may be implemented. The computing-based device may be an electronic device. For example, the computing-based device may be a mobile telephone, a hands-free headset, a personal audio player or a conference call unit. The computing-based device illustrates functionality used for adaptively estimating a target sound signal.

Computing-based device 400 comprises a processor 410 for processing computer executable instructions configured to control the operation of the device in order to perform the estimation method. The computer executable instructions can be provided using any computer-readable media such as memory 420. Further software that can be provided at the computing-based device 400 includes cost function calculation logic 401, gradients computation logic 402, step-size control logic 403, uncertain factors optimization logic 404, uncertain factors limitation logic 405 and beamforming weights reconstruction logic 406. Alternatively, logic 401-406 may be implemented partially or wholly in hardware. Data store 430 stores data such as the generated cost functions, uncertain factors and beamforming weights. Computing-based device 400 further comprises a reception interface 440 for receiving data and an output interface 450. For example, the output interface 450 may output an audio signal representing the estimated target sound signal to a speaker.

In FIG. 4 a single computing-based device has been illustrated in which the described estimation method may be implemented. However, the functionality of computing-based device 400 may be implemented on multiple separate computing-based devices The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A method for adaptively estimating a target sound signal, the method comprising:

establishing a simulation model simulating an audio environment comprising:

a plurality of spatially separated microphones, a target sound source, and a number of audio noise sources;

setting an initial value for each of one or more variables, each variable parameterising a comparison of audio signals received at a respective first one of the plurality of microphones with audio signals received at a respective second one of the plurality of microphones;

in dependence on dynamic changes in the comparison of audio signals received by the plurality of microphones, iteratively updating the value of said one or more variables;

using the updated value of said one or more variables to determine a respective adaptive beamforming weight for each of the plurality of microphones; and summing the audio signals received by each of the plurality of microphones according to their respective beamformer weights to produce an estimate of the target sound signal.

2. An adaptive beamforming system for estimating a target sound signal in an audio environment comprising a target sound source and a number of audio noise sources, the system comprising:

a plurality of spatially separated microphones;

a beamformer unit to which signals received by the plurality of microphones are input, and which is configured to estimate the target sound signal by summing the signals from the plurality of microphones according to beamformer weights; and an optimization unit to which the output of the beamformer unit is input, and which is configured to output a control signal to the beamformer unit which adaptively adjusts the beamformer weights;

wherein the optimization unit is configured to:

set an initial value for each of one or more variables, each variable parameterising a comparison of audio signals received at a respective first one of the plurality of microphones with audio signals received at a respective second one of the plurality of microphones;

in dependence on dynamic changes in the comparison of audio signals received by the plurality of microphones, iteratively updating the value of said one or more variables; and use the updated value of said one or more variables to construct the control signal.

3. A system as claimed in claim 2, further comprising a single channel post-filter configured to produce an estimate of the target sound source power from the beamformer unit output.

4. A system as claimed in claim 2, wherein one of the one or more variables parameterises the difference in the amplitude of the target sound signal received by each of the plurality of microphones compared to one of the plurality of microphones designated as a reference microphone.

5. A system as claimed in claim 2, wherein the initial value of at least one of said one or more variables is set according to a far-field approximation.

6. A system as claimed in claim 4, wherein the variable parameterising the difference in the amplitude of the target sound signal received by each of the plurality of microphones compared to one of the plurality of microphones designated as a reference microphone is limited to plus or minus less than a tenth of its initial value.

7. A system as claimed in claim 2, wherein for one or more of the one or more variables the comparison is with respect to the quality of the audio signals received at the respective first and second ones of the plurality of microphones.

8. A system as claimed in claim 7, wherein for one or more of the one or more variables the comparison is with respect to an estimation of the net signal received at each of the respective first and second ones of the plurality of microphones from the number of audio noise sources.

9. A system as claimed in claim 8, wherein for one or more of the one or more variables the first one of the plurality of microphones is the same as the second one of the plurality of microphones.

10. A system as claimed in claim 9, wherein one or more of the one or more variables parameterises an average degree of self-correlation of:

the net signal received by one of the plurality of microphones from the number of audio noise sources; or an average of the net signals received by the plurality of microphones from the number of audio noise sources.

11. A system as claimed in claim 8, wherein for one or more of the one or more variables the first one of the plurality of microphones is different to the second one of the plurality of microphones.

12. A system as claimed claim 11, wherein one or more of the one or more variables parameterises a degree of cross correlation of the net signal received by each respective first one of the plurality of microphones from the number of audio noise sources with the net signal received by each respective second one of the plurality of microphones from the number of audio noise sources.

13. A system as claimed in claim 7, wherein the initial value of each of the said one or more variables is set such that an initial estimation of the correlation matrix formed by cross correlating the estimated net signals received by each of the plurality of microphones from the number of audio noise sources with each other is equal to the diffuse noise correlation matrix for said plurality of spatially separated microphones.

14. A system as claimed in claim 10, wherein the variable parameterising the average degree of self-correlation of the net signal received by one of the plurality of microphones from the number of audio noise sources is limited to be greater than or equal to unity and less than or equal to approximately 100.

15. A system as claimed in claim 12, wherein the one or more variables parameterising the degree of cross correlation of the net signal received by each respective first one of the plurality of microphones from the number of audio noise sources with the net signal received by each respective second one of the plurality of microphones from the number of audio noise sources are limited to having real components greater than or equal to zero and less than approximately unity, and imaginary parts between approximately plus and minus 0.1.

16. A system as claimed in claim 2, wherein the one or more variables are updated according to a steepest descent method.

17. A system as claimed in claim 16, wherein a normalised least mean square (NLMS) algorithm is used to limit a step size used in the steepest descent method.

18. A system as claimed in claim 17, wherein the NLMS algorithm comprises a step of estimating the power of the signals received by each of the plurality of microphones, and wherein that step is performed by a 1-tap recursive filter with adjustable time coefficient or weighted windows with adjustable time span which averages the power in each frequency bin.

19. A system as claimed in claim 16, wherein the step size used in the steepest descent method is reduced to a greater extent the greater the ratio of estimated target signal power to the signal power received by one of the plurality of microphones designated as a reference microphone.

20. A system as claimed in claim 2, wherein the phase of the estimated target signal is the phase of one of the plurality of microphones designated as a reference microphone.

* * * * *